United States Patent [19]

Whitworth

[11] 4,391,593

[45] Jul. 5, 1983

[54] PROPULSION DRIVE SYSTEMS

[76] Inventor: Edward Whitworth, R.R. #3, Port Rowan, Ontario, Canada

[21] Appl. No.: 83,458

[22] Filed: Oct. 10, 1979

[51] Int. Cl.[3] ..... B63H 1/14

[52] U.S. Cl. ..... 440/70; 114/162

[58] Field of Search ..... 114/56, 162; 440/66, 440/67, 68, 69, 70, 71, 73, 43, 78, 79, 112, 47, 83, 88, 89

[56] References Cited

U.S. PATENT DOCUMENTS

| | | | |
|---|---|---|---|
| 899,359 | 9/1908 | Wadagaki | 440/67 |
| 2,099,229 | 11/1937 | Possenheim | 114/162 |
| 2,275,618 | 3/1942 | Edwards | 440/67 |
| 3,040,694 | 9/1982 | Cochran | 440/43 |
| 3,120,829 | 2/1964 | Chew | 114/162 |
| 3,447,324 | 6/1969 | French | 440/47 |
| 3,635,186 | 1/1972 | German | 440/67 |
| 3,752,111 | 8/1973 | Meynier | 440/112 |
| 3,768,432 | 10/1973 | Spaulding | 440/67 |
| 4,057,027 | 11/1977 | Foster | 440/69 |

*Primary Examiner*—Trygve M. Blix
*Assistant Examiner*—Stephen P. Avila
*Attorney, Agent, or Firm*—Daryl W. Schnurr

[57] ABSTRACT

A propulsion drive system for a boat is provided where a propeller is centered within a tunnel. A converging channel, open towards the bottom, extends in front of the tunnel and a converging nozzle extends from the rear of the tunnel. The system is provided with apparatus for mounting the propeller in the center of the tunnel widthwise and a suitable rudder is mounted to the rear of the converging nozzle. The propulsion drive system can operate quietly with little vibration and no cavitation.

13 Claims, 5 Drawing Figures

PROPULSION DRIVE SYSTEMS

BACKGROUND OF THE INVENTION

1. Field of the Invention

This invention relates to a propulsion drive system for a boat.

2. Description of the Prior Art

Previous drive systems for boats suffer from deficiencies in that cavitation of the propeller occurs at high speed, unacceptable vibrations occur at high speeds, the noise level during operation is unacceptable or the boat does not move at sufficient speed in view of the revolutions per minute of the motor.

SUMMARY OF THE INVENTION

This invention relates to a propulsion drive system for a boat comprising:

(a) a tunnel insect into the bottom of said boat commencing at the stern and extending a relatively short distance towards the bow, said tunnel being cylindrical in shape;

(b) a channel in the bottom of said boat extending in front of said tunnel and gradually decreasing in size towards the bow until the channel disappears completely, said channel being open towards the bottom of the boat and having a cross-sectional area slightly larger than the outside diameter of the tunnel where the tunnel and the channel meet, said tunnel having a circular leading edge that is tapered throughout its circumference from an inner wall to an outer wall of said tunnel to allow for a smooth transition between the channel and the tunnel;

(c) a shaft extending from a motor in said boat to a propeller centred widthwise in said tunnel near said stern, said propeller having a small diameter relative to the size of said tunnel, said shaft being enclosed in a suitable log;

(d) means for mounting said log within the tunnel to maintain the propeller in the centre;

(e) a converging nozzle mounted along the rear of a trailing edge of said tunnel;

(f) a suitable rudder mounted to the rear of said converging nozzle.

BRIEF DESCRIPTION OF THE DRAWINGS

In drawings which illustrate the embodiments of the invention.

DESCRIPTION OF A PREFERRED EMBODIMENT

Figure 1:
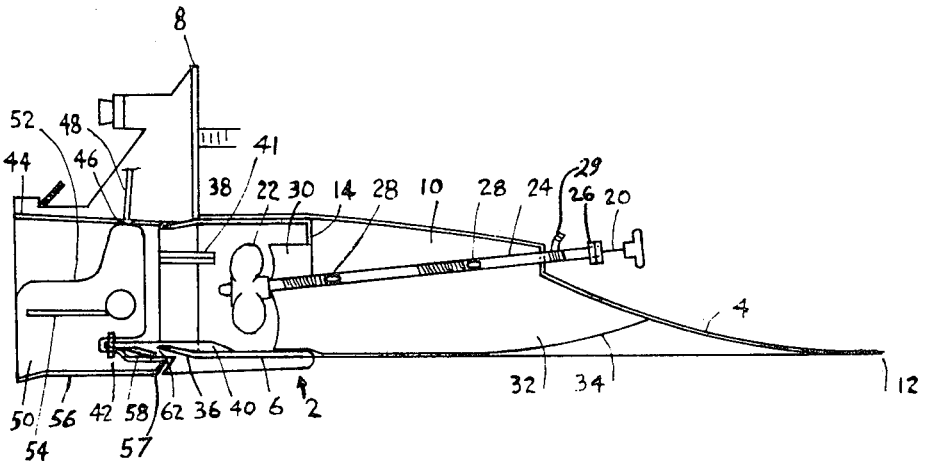
FIG. 1 is a partial sectional view of a propulsion drive system of the present invention showing a rudder and a propeller.

Referring to FIG. 1 in greater detail, there is shown a propulsion drive system 2 that is designed to be mounted on the bottom of a boat 4 (partially shown). A tunnel 6 is inset into the bottom of the boat 4 commencing at the stern 8 and extending a relatively short distance towards the bow (not shown), said tunnel 6 being cylindrical in shape. A channel 10 in the bottom of said boat 4 extends in front of the tunnel 6 and gradually decreases in size towards the bow until the channel disappears completely at point 12. The channel 10 is open towards the bottom of the boat 4 and has a cross-sectional area slightly larger than the outside diameter of the tunnel 6 where the tunnel 6 and the channel 10 meet. The tunnel 6 has a circular leading edge 14 that is tapered throughout its circumference from an inner wall 16 to an outer wall 18 to allow for a smooth transition between the tunnel 6 and the channel 10 where they meet. The leading edge 14 is tapered throughout its circumference to increase the velocity of the water flowing into it during the operation of the propulsion system 2 thereby reducing the chance of cavitation of a propeller to be described later.

A shaft 20 extends from a motor (not shown) located in said boat 4 to a propeller 22 centred in said tunnel 6. The propeller 22 has a small diameter relative to the size of said tunnel 6. The propeller 22 shown in FIG. 1 is tilted slightly backwards from the vertical when the boat is in a horizontal position. The tilt of the propeller 22 is not particularly important to this invention but preferably, the propeller is vertical or as close to vertical as possible when the boat is in a horizontal position. The tilt of the propeller 22 will be determined by the limitation of the angle of the shaft 20 as it enters the boat. It is a requirement of this invention that the propeller be centred widthwise within said tunnel 6. Preferably, the propeller 22 is also centred lengthwise within the tunnel 6. The shaft 20 is enclosed within a suitable log 24. The log 24 contains two water cooled bearings (not shown) mounted within said log 24, one bearing being mounted immediately in front of the propeller 22 and the other bearing being mounted midway between the propeller bearing and an end 26 of the log 24. Water passages 28 located in front of each of the bearings allows the bearings to be water cooled and lubricated. Water is also fed through these passages 28 through the log 24 and nozzle 29 to cool the motor.

Two struts 30 (only one of which is shown) extend radially from the log 24 to the inner wall 16 of the tunnel 6 in front of the propeller 22. A keel 32 extends vertically below the log 24 when the boat 4 is in a horizontal position, to the inner wall 16 of the tunnel 6 in front of the propeller 22 and towards the point 12 in the channel 10, the bottom edge 34 of the keel curving slightly upwards to meet the wall of the channel 10 between the log 24 and the point 12. The struts 30 are located 120 degrees apart from one another and from the keel 32. The keel 32 could be eliminated and replaced by a strut, similar in shape to the struts 30, extending vertically below the log 24. Preferably, three struts are used to centre the propeller but any number of struts could be used so long as they have sufficient strength to maintain the propeller 22 within the centre of the tunnel 6 and are not so large as to substantially reduce the cross-sectional area of the opening in the tunnel 6. The struts 30 and the keel 32 form means for mounting said log 24 within the tunnel 6 to maintain the propeller 22 in the centre. A converging nozzle 36 is mounted along a trailing edge 38 of said tunnel 6. The purpose of the converging nozzle 36 is to increase the velocity of the water passing from the propeller 22.

Figure 4:
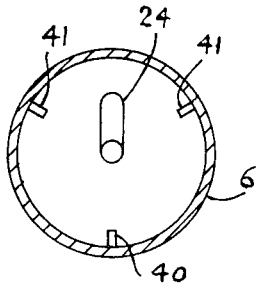
FIG. 4 is an end view of the portion of a tunnel to the rear of the propeller.

Within the tunnel 6 and the converging nozzle 36, there are located three flow stabilizer fins 40, 41 (best shown in FIG. 4). The fins 40, 41 are aligned with the struts 30 and the keel 32. The bottom fin 40 has a slightly different shape than the upper fins 41 as it extends rearwardly to form a bearing containing a lower rudder shaft 42. A semi-circular diverging nozzle 44 extends rearwardly from an upper half of the converging nozzle 36. The diverging nozzle 44 contains a bearing 46, which in turn contains an upper rudder shaft 48. A rudder 50 is mounted on the rudder shafts 42, 48 to the rear of the converging nozzle 36. The rudder 50 can be any convenient shape so long as it is of sufficient size to maintain control of the boat 4 and so long as an upper portion of the tail 52 is cut away so that the rudder 50 does not overly restrict the jet stream when the boat is being turned. Preferably, fins 54, 56 are mounted on each side of the rudder to increase the efficiency of the rudder by limiting the flow of water over and under the rudder during turning operations.

Figure 2:
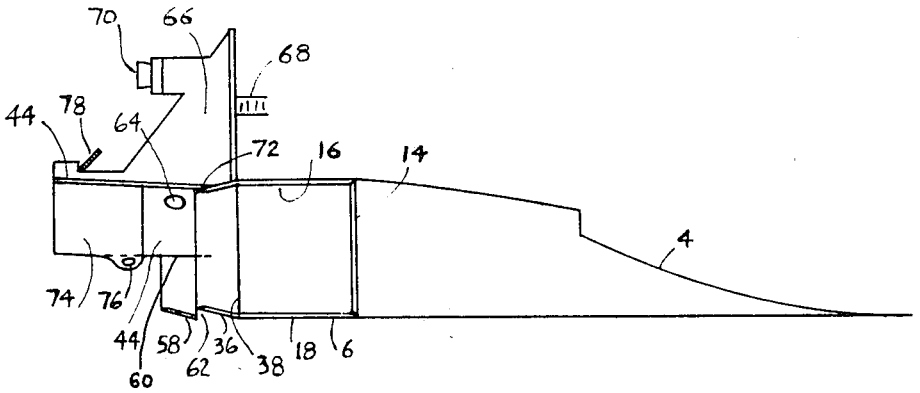
FIG. 2 is a partial sectional view of a propulsion drive system of the present invention showing those parts located behind the rudder of FIG. 1.

Referring to FIG. 2 in greater detail, a semi-circular scoop 58 is mounted between the converging nozzle 36 and the rudder 50. The scoop 58 is attached at the bottom to the fin 40 and at the top to a bottom edge 60 of the diverging nozzle 44. An annular space 62 of semi-circular shape is formed between the scoop 58 and the converging nozzle 36. Water from outside the tunnel 6 enters the space 62 and is forced into the jet stream. It was found that this increased the efficiency of the propulsion system 2.

Figure 3:
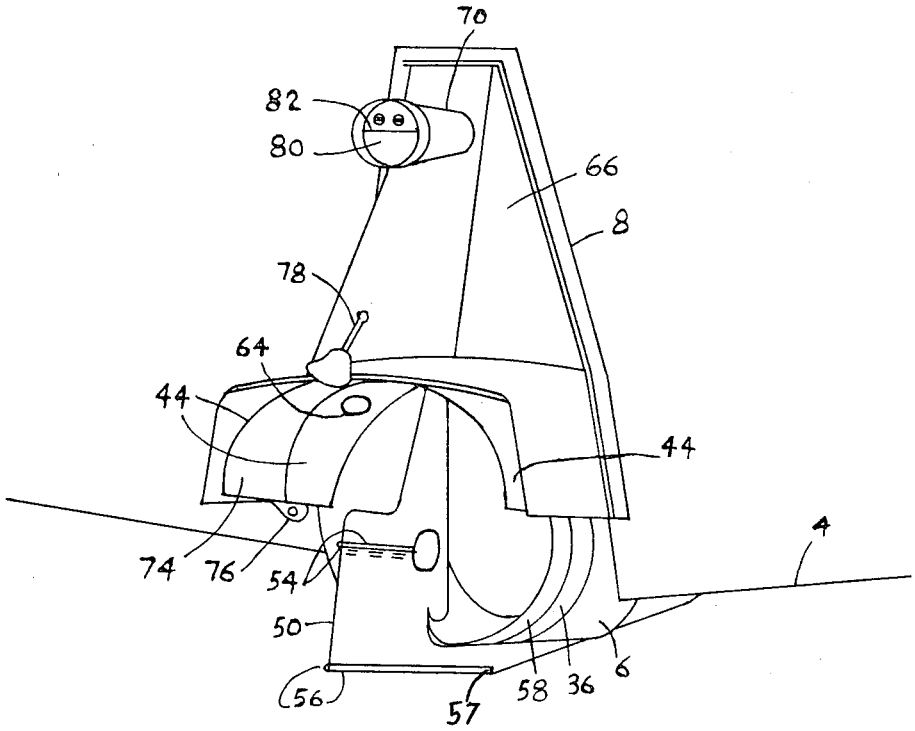
FIG. 3 is a perspective view of a propulsion drive system of the present invention from the rear of the boat.

The diverging nozzle 44 contains two holes 64 (only one of which is shown in FIG. 2). The holes 64 form a passage way to an exhaust cavity 66. The exhaust cavity 66 is connected to the exhaust from the motor through inlet 68. The holes 64 provide an exhaust outlet into the jet stream. A second exhaust outlet 70 best shown in FIGS. 3 and 5 can be manually opened and closed. The converging nozzle 36 extends slightly into the diverging nozzle 44 as shown at point 72. This creates a vacuum at the hole 64 when the boat is moving forward. This vacuum draws the exhaust from the motor and the cavity 66 into the jet stream, thereby greatly reducing the noise of the exhaust. The entry of the exhaust gases into the jet stream further lowers the velocity of the jet stream and again raises the pressure against the diverging nozzle 44 to increase the forward speed of the boat. When the motor is in reverse, the manual exhaust 70 must be opened so that exhaust gases will exit through the exhaust 70 rather than through the holes 64. If the manual exhaust 70 is not opened, the exhaust gases tend to be drawn into the propeller, thereby causing cavitation.

An inner liner 74 is pivotally mounted within the rear portion of the diverging nozzle 44. The liner 74 is pivoted at points 76 (only one of which is shown in FIG. 2) and the distance of the rear portion of the liner 74 from the rear portion of the diverging nozzle 44 is adjustable by means of a screw 78. The liner 74 can be properly adjusted to control the attitude of the nose or keel of the boat 4.

During experimentation, it was found that the efficiency of the propulsion drive system greatly increased when the jet stream changed from a subsonic shape to a supersonic shape. A subsonic shaped jet stream occurs when the sides of the jet stream are either parallel or they converge as the jet stream leaves the boat. A supersonic jet stream is a jet stream where the sides of the jet stream diverge as the jet stream leaves the boat. With the present invention, a supersonic jet stream is attained at virtually all speeds.

The diverging nozzle 44 diverges towards the rear.

Figure 5:
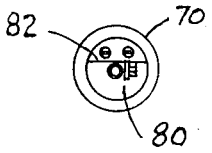
FIG. 5 is an end view of the upper exhaust from the motor.

The exhaust as shown in FIG. 5 is manually operated from the dash and the bottom portion 80 is hinged along a line 82 so that it flips up when it is opened.

What I claim as my invention is:

1. A propulsion drive system for a boat comprising:

(a) a tunnel inset into the bottom of said boat commencing at the stern and extending a relatively short distance towards the bow, said tunnel being cylindrical in shape;

(b) a channel in the bottom of said boat extending in front of said tunnel and gradually decreasing in size towards the bow until the channel disappears completely, said channel being open towards the bottom of the boat and having a cross-sectional area slightly larger than the outside diameter of the tunnel where the tunnel and the channel meet, said tunnel having a circular leading edge that is tapered throughout its circumference from an inner wall to an outer wall of said tunnel to allow for a smooth transition between the channel and the tunnel;

(c) a shaft extending from a motor in said boat to a propeller centred widthwise in said tunnel near said stern, said propeller having a small diameter relative to the size of said tunnel, said shaft being enclosed in a suitable log;

(d) means for mounting said log within the tunnel to maintain the propeller in the centre;

(e) a converging nozzle mounted along the rear of a trailing edge of said tunnel;

(f) a suitable rudder mounted to the rear of said converging nozzle;

(g) said log containing water cooled bearings and holes or water passages in front of each of said bearings so that water from the location where the boat is being operated can come into contact with said bearings;

(h) appropriate passages so that the motor is cooled from water passing through said holes in said log.

2. A propulsion drive system for a boat comprising:

(a) a tunnel inset into the bottom of said boat commencing at the stern and extending a relatively short distance towards the bow, said tunnel being cylindrical in shape;

(b) a channel in the bottom of said boat extending in front of said tunnel and gradually decreasing in size towards the bow until the channel disappears completely, said channel being open towards the bottom of the boat and having a cross-sectional area slightly larger than the outside diameter of the tunnel where the tunnel and the channel meet, said tunnel having a circular leading edge that is tapered throughout its circumference from an inner wall to an outer wall of said tunnel to allow for a smooth transition between the channel and the tunnel;

(c) a shaft extending from a motor in said boat to a propeller centred widthwise in said tunnel near said stern, said propeller having a small diameter relative to the size of said tunnel, said shaft being enclosed in a suitable log;

(d) means for mounting said log within the tunnel to maintain the propeller in the centre;

(e) a converging nozzle mounted along the rear of a trailing edge of said tunnel;

(f) a suitable rudder mounted to the rear of said converging nozzle; and (g) a diverging nozzle of semi-circular cross-section extending from an upper half of said converging nozzle rearwardly above said rudder.

3. A propulsion drive system as claimed in claim 2 wherein a scoop having a semi-circular cross-section and tapering slightly inwards is mounted to the rear of a bottom portion of the converging nozzle, said scoop being substantially the same size and shape as the bottom portion of the converging nozzle.

4. A propulsion drive system as claimed in claim 2 wherein an inner liner is pivotally mounted within a rear portion of the diverging nozzle so that a rear portion of said inner liner can be moved relative to an adjacent portion of the diverging nozzle.

5. A propulsion drive system as claimed in any one of claims 2 or 3 wherein the means for mounting said log within the tunnel to maintain the propeller in the center comprise three struts, substantially equidistant from one another extending from said log to an inner wall of said tunnel in front of said propeller.

6. A propulsion drive system as claimed in claim 5 wherein one of said struts extends vertically downward from said log when the boat is in a horizontal position and forms a keel for said boat extending from the log to the inner wall of the tunnel in front of the propeller, a bottom edge of said keel extending from the tunnel essentially parallel to said log and curving smoothly upwards to meet a wall of the channel at a point between said log and an end of the channel closer to the bow.

7. A propulsion drive system as claimed in any one of claims 2 or 3 wherein there are three flow stabilizer fins located equidistant from one another within said tunnel and said converging nozzle, the fins being aligned with the struts.

8. A propulsion drive system as claimed in any one of claims 2 or 3 wherein the rudder has a tail with an upper portion of said tail cut away.

9. A propulsion drive system as claimed in any one of claims 2, 3 or 4 wherein the exhaust from a motor of the boat is directed into a space beneath the diverging nozzle for forward and neutral operation of the boat and directed into the ambient air for reverse operation of the boat.

10. A propulsion drive system as claimed in any one of claims 2 or 3 wherein there are two fins mounted on each side of said rudder, the upper fins being slightly below the mid-point of the tunnel and extending from the pivot point of the rudder to the rear of the rudder with the lower fins extending along the bottom portion of the rudder, said lower fins being adjustable.

11. A propulsion drive system as claimed in any one of claims 2 or 3 wherein the log contains water cooled bearings, the log containing holes or water passages in front of each of said bearings so that water from the location where the boat is being operated can come into contact with said bearings.

12. A propulsion drive system as claimed in claim 11 wherein there are appropriate passages so that the motor is cooled from water passing through said holes in the log.

13. A propulsion drive system as claimed in any one of claims 2 or 3 wherein the propeller is centered lengthwise within said tunnel.

* * * * *